US009701469B1

(12) United States Patent
Reith

(10) Patent No.: US 9,701,469 B1
(45) Date of Patent: Jul. 11, 2017

(54) COMBINATION TRASH LINER STORAGE AND TRASH RECEPTACLE

(71) Applicant: Tracy L. Reith, McKeesport, PA (US)

(72) Inventor: Tracy L. Reith, McKeesport, PA (US)

( * ) Notice: Subject to any disclaimer, the term of this patent is extended or adjusted under 35 U.S.C. 154(b) by 0 days.

(21) Appl. No.: 14/992,079

(22) Filed: Jan. 11, 2016

(51) Int. Cl.
*B65F 1/06* (2006.01)
*B65F 1/14* (2006.01)

(52) U.S. Cl.
CPC ..... *B65F 1/062* (2013.01); *B65F 1/14* (2013.01)

(58) Field of Classification Search
CPC ..... B65F 1/067; B65F 1/065; B65F 1/062; B65F 1/06; B65F 1/04; B65F 1/14; B65F 1/068; B65D 25/14; B65D 25/16; B65D 25/18; B65D 90/046
USPC ..... 220/495.04, 495.07, 495.06, 495.01, 220/908.1, 908
See application file for complete search history.

(56) References Cited

U.S. PATENT DOCUMENTS 3,451,453 A * 6/1969 Heck ..... B65F 1/062 206/390
4,319,694 A 3/1982 Nehrbass et al.
4,955,505 A 9/1990 Battaglia
5,503,292 A 4/1996 Cuccharia
5,738,239 A 4/1998 Triglia
6,102,343 A * 8/2000 Grimesey ..... B65F 1/06 220/908
6,193,095 B1 2/2001 McNeil
D573,770 S 7/2008 Kindig
8,490,813 B2 7/2013 Leon

FOREIGN PATENT DOCUMENTS

GB 2360195 A * 9/2001 ..... B65F 1/06

* cited by examiner

*Primary Examiner* — Robert J Hicks

(57) ABSTRACT

A combination trash liner storage and trash receptacle having integrated trash liner storage includes a housing that comprises a wall extending upwardly from a bottom defining an open top. Each of a plurality of fasteners is coupled to an interior surface of the housing proximate to a bottom of the housing. Each fastener is positioned equally distant from the bottom defining an internal perimeter of the housing. A panel that is substantially complementary to the internal perimeter is reversibly couplable to the fasteners. The fasteners are positioned on the interior wall such that the panel is couplable to the fasteners to position the panel in substantial parallelism with the bottom. A slot is positioned in the panel for insertion of an end of a roll of trash can liners. A plurality of penetrations is positioned in the wall to allow air to pass through the wall of the housing.

19 Claims, 4 Drawing Sheets

COMBINATION TRASH LINER STORAGE AND TRASH RECEPTACLE

BACKGROUND OF THE DISCLOSURE

Field of the Disclosure

The disclosure relates to trash receptacles and more particularly pertains to a new trash receptacle having integrated trash liner storage.

SUMMARY OF THE DISCLOSURE

An embodiment of the disclosure meets the needs presented above by generally comprising a housing that comprises a wall extending upwardly from a bottom defining an open top. Each of a plurality of fasteners is coupled to an interior surface of the housing proximate to a bottom of the housing. Each fastener is positioned equally distant from the bottom defining an internal perimeter of the housing. A panel that is substantially complementary to the internal perimeter is reversibly couplable to the fasteners. The fasteners are positioned on the interior wall such that the panel is couplable to the fasteners to position the panel in substantial parallelism with the bottom. A slot is positioned in the panel for insertion of an end of a roll of trash can liners. A plurality of penetrations is positioned in the wall to allow air to pass through the wall of the housing.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
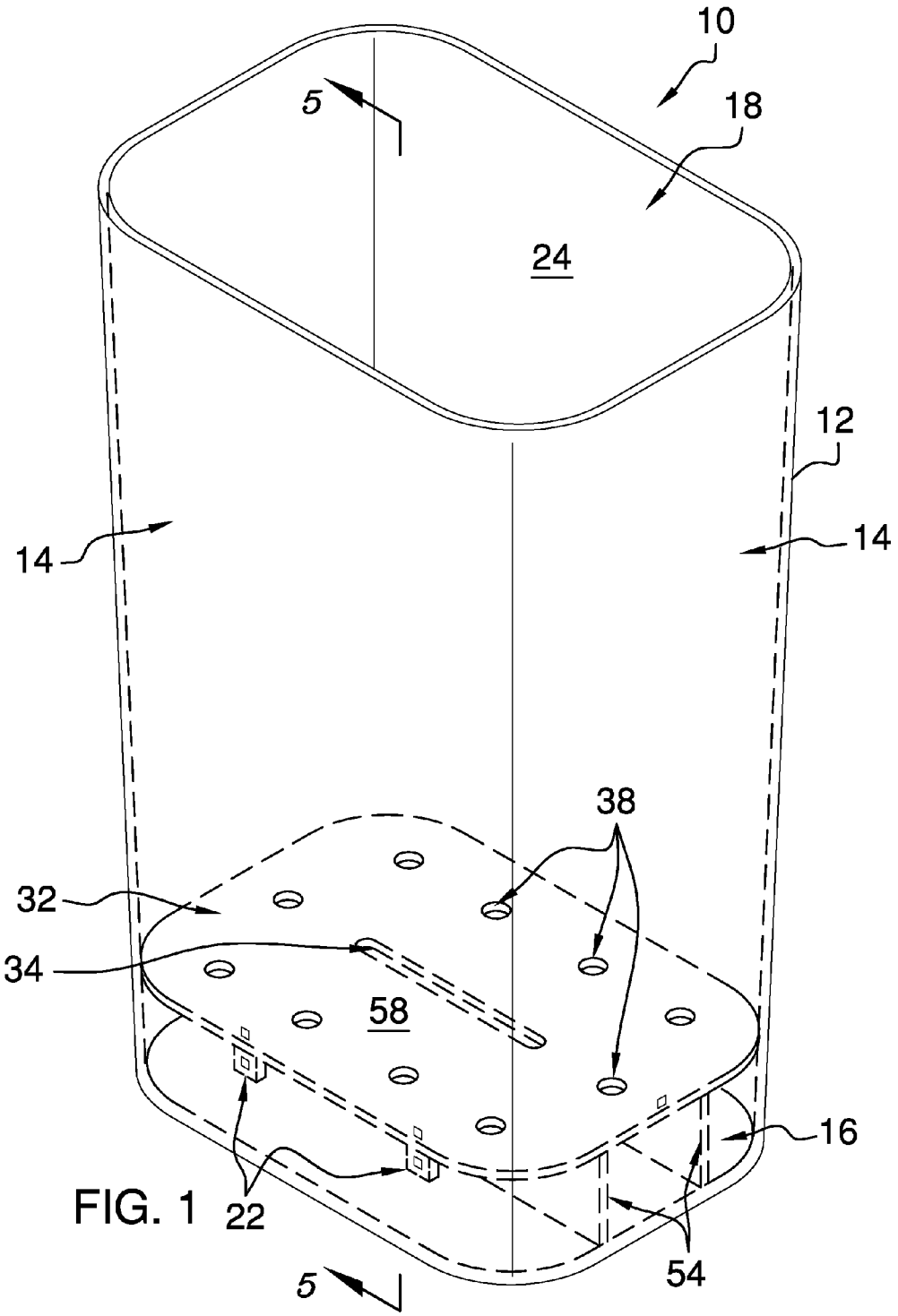
FIG. 1 is a cut-away view of a Combination trash liner storage and trash receptacle according to an embodiment of the disclosure.
Figure 2:
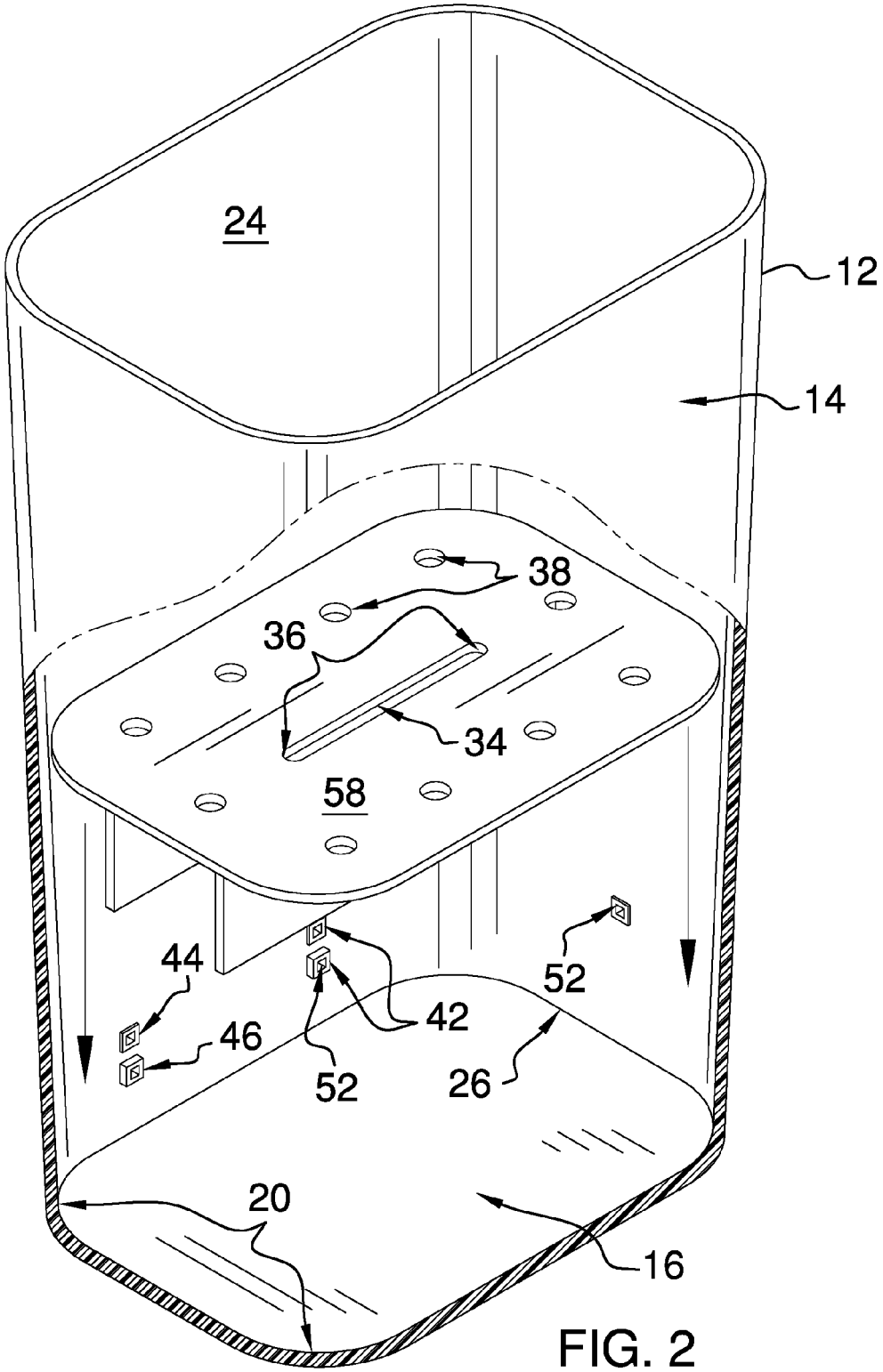
FIG. 2 is a cut-away view of an embodiment of the disclosure.
Figure 4:
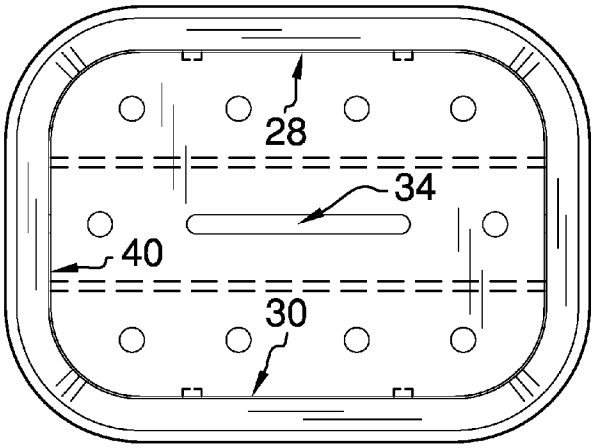
FIG. 4 is a top view of an embodiment of the disclosure.
Figure 3:
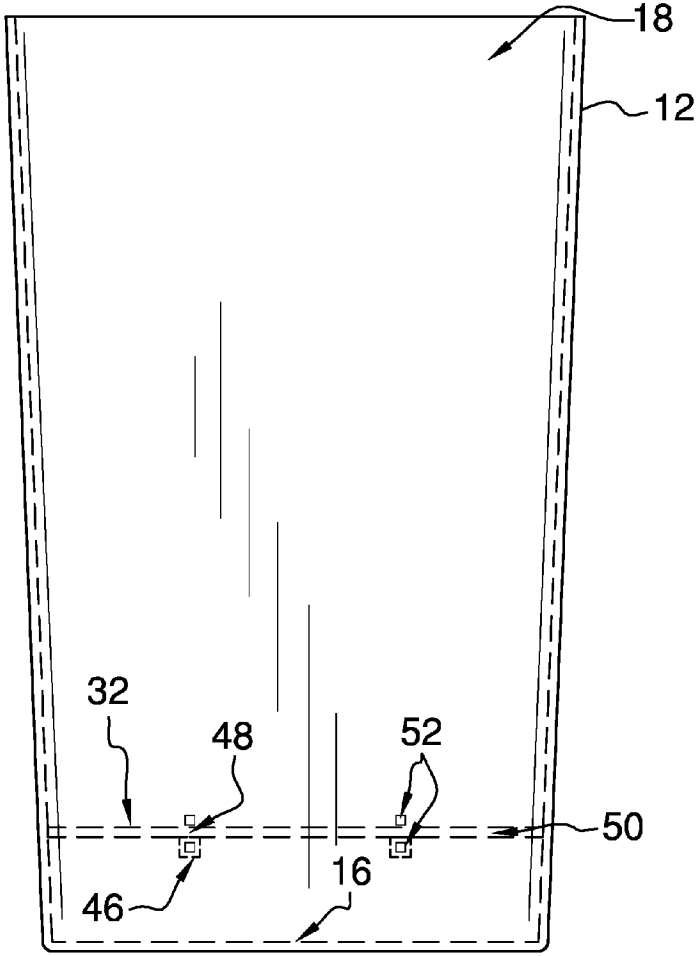
FIG. 3 is a side view of an embodiment of the disclosure.
Figure 5:
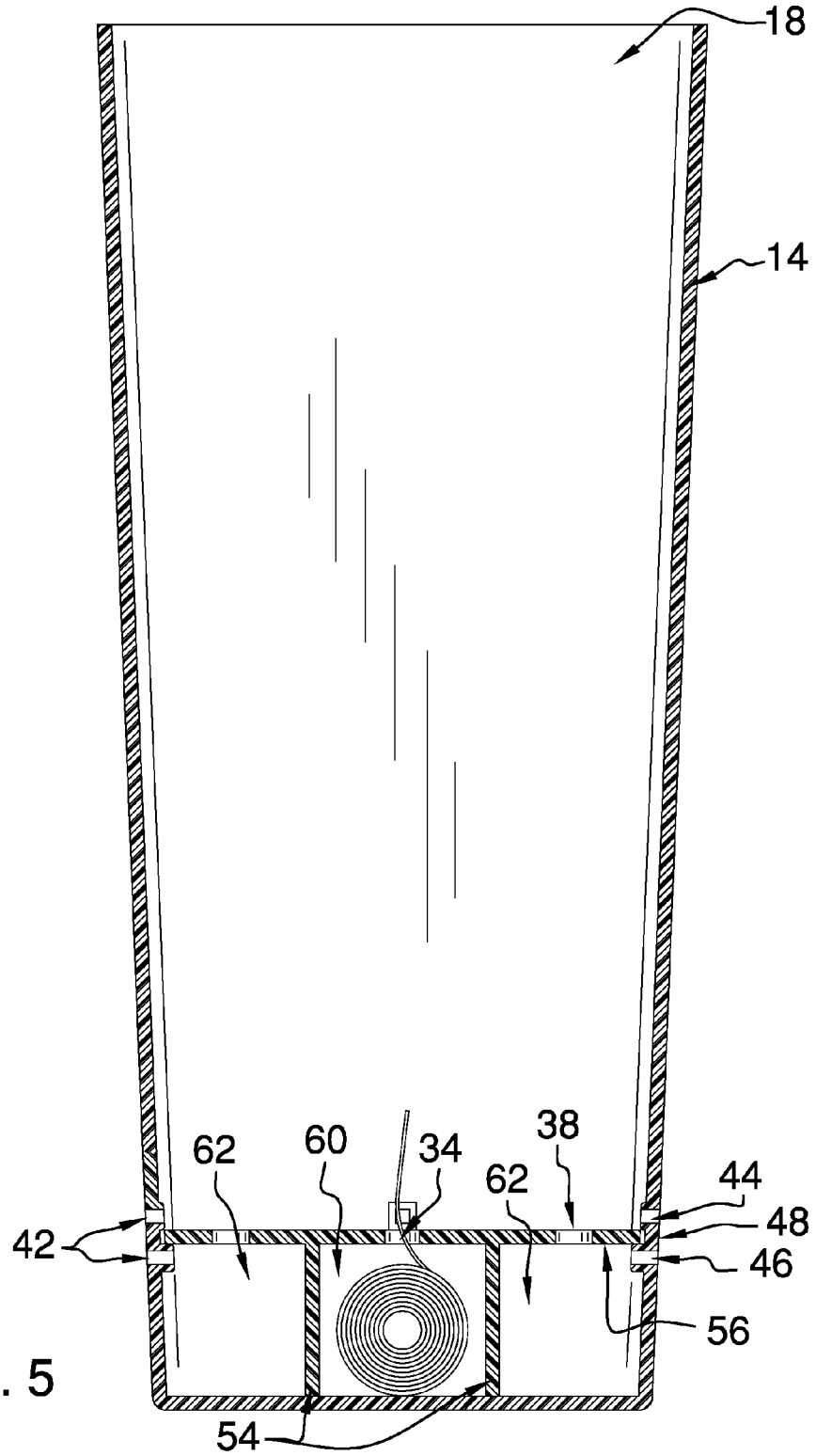
FIG. 5 is a cross-sectional view of an embodiment of the disclosure.

With reference now to the drawings, and in particular to FIGS. 1 through 5 thereof, a new trash receptacle embodying the principles and concepts of an embodiment of the disclosure and generally designated by the reference numeral 10 will be described.

As best illustrated in FIGS. 1 through 5, the combination trash liner storage and trash receptacle 10 generally comprises a housing 12 that comprises a wall 14 extending upwardly from a bottom 16 defining an open top 18. Preferably, the bottom 16 is substantially rectangular, such that the housing is substantially rectangularly box shaped. Also preferably, the bottom 16 has rounded corners 20.

Each of a plurality of fasteners 22 is coupled to an interior surface 24 of the housing 12 proximate to the bottom 16 of the housing 12. Each of the plurality of fasteners 22 is positioned equally distant from the bottom 16 defining an internal perimeter 26 of the housing 12. Preferably, the plurality of fasteners 22 comprises four fasteners 22. Two of the fasteners 22 are coupled to a first opposing wall 28 of the housing 12 and another two of the fasteners 22 are coupled to a second opposing wall 30 of the housing 12. A respective fastener 22 coupled to the first opposing wall 28 is aligned with a respective fastener 22 coupled to the second opposing wall 30.

The receptacle 10 comprises a panel 32 that is substantially complementary to the internal perimeter 26. The panel 32 is reversibly couplable to the fasteners 22 to position the panel 32 in substantial parallelism with the bottom 16. A slot 34 is positioned in the panel 32. Preferably, the slot 34 is substantially centrally positioned in the panel 32. The slot 34 is elongated and has rounded ends 36.

A plurality of holes 38 is positioned through the panel 32 between the slot 34 and an edge 40 of the panel 32. Preferably, the holes 38 are substantially circular and substantially evenly spaced. The plurality of holes 38 comprises between four and twenty holes 38. Preferably, the plurality of holes 38 comprises between eight and twelve holes 38. More preferably, the plurality of holes 38 comprises ten holes 38.

Each fastener 22 may comprise a pair of extrusions 42. Each of the pair of extrusions 42 is vertically aligned defining an upper extrusion 44 and a lower extrusion 46. The upper extrusion 44 and the lower extrusion 46 are separated by a gap 48 that is complementary to a thickness 50 of the panel 32. The lower extrusion 46 extends from the wall 14 further than the upper extrusion 44. The upper extrusion 44 is deformable, such that the panel 32 is insertable through the open top 18 of the housing 12 and positionable in the gap 48. The lower extrusions 46 and the upper extrusions 44 retain the panel 32 in the gap 48. Preferably, the extrusions 42 are substantially rectangular.

A plurality of penetrations 52 is positioned in the wall 14. The penetrations 52 are configured to allow air to pass through the wall 14 of the housing 12. Preferably, a penetration 52 is positioned through a respective lower extrusion 46 and a penetration 52 is positioned through a respective upper extrusion 44. The penetrations 52 are substantially rectangular.

The receptacle 10 may comprise a plurality of slats 54 that is coupled to and extends perpendicularly from a lower face 56 of the panel 32. The slats 54 are positioned in parallel on the lower face 56, such that the slats 54 extend from the lower face 56 to the bottom 16 when the panel 32 is positioned in the gap 38. The slats 54 are positioned on the panel 32 such that the panel 32 is configured to support items placed onto an upper face 58 of the panel 32. Preferably, the plurality of slats 54 comprises two slats 54 that define a central compartment 60. The central compartment 60 comprises the slot 34 and is substantially rectangularly box shaped. The slats 54 also define a pair of outer compartments 62. Preferably, each of the outer compartments 62 and the central compartment 60 are substantially equally sized.

In use, the slot 34 is configured for insertion of an end of a roll of trash can liners such that the roll of trash can liners is positioned adjacent to the lower face 56 of the panel 32. The panel 32 is insertable through the open top 18 such that the panel 32 is coupled to the fasteners 22. The open top 18 is configured to couple with the open end of the trash can liner. The penetrations 52 are positioned in the wall 14 such that air can escape through the wall 14 as items are added to the trash can liner.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. Combination trash liner storage and trash receptacle comprising:

a housing, said housing comprising a wall extending upwardly from a bottom defining an open top;

a plurality of fasteners, each said fastener being coupled to an interior surface of said housing proximate to a bottom of said housing, each of said plurality of fasteners being positioned equally distant from said bottom defining an internal perimeter of said housing;

a panel, said panel being substantially complementary to said internal perimeter, said panel being reversibly couplable to said fasteners, wherein said fasteners are positioned on said interior surface such that said panel is couplable to said fasteners to position said panel in substantial parallelism with said bottom;

a slot, said slot being positioned in said panel;

a plurality of penetrations, said penetrations being positioned in said wall, wherein said penetrations are configured to allow air to pass through said wall of said housing;

wherein said slot is configured for insertion of an end of a roll of trash can liners such that the roll of trash can liners is positioned adjacent to said lower face of said panel, wherein said panel is insertable through said open top such that said panel is coupled to said fasteners, wherein said open top is configured to couple with the open end of the trash can liner, and wherein said penetrations are positioned in said wall such that air can escape through said wall as items are added to the trash can liner; and each said fastener comprising a pair of extrusions, each of said pair of extrusions being vertically aligned defining an upper extrusion and a lower extrusion, said upper extrusion and said lower extrusion being separated by a gap, said gap being complementary to a thickness of said panel, said lower extrusion extending from said wall further than said upper extrusion, said upper extrusion being deformable, wherein said panel is insertable through said open top of said housing, such that said panel is positionable in said gap with said lower extrusions and said upper extrusions retaining said panel in said gap.

2. The receptacle of claim 1, further including said bottom being substantially rectangular, wherein said housing is substantially rectangularly box shaped.

3. The receptacle of claim 2, further including said bottom having rounded corners.

4. The receptacle of claim 2, further including said plurality of fasteners comprising four fasteners, two of said fasteners being coupled to a first opposing wall of said housing, another two of said fasteners being coupled to a second opposing wall of said housing, such that a respective said fastener coupled to said first opposing wall is aligned with a respective said fastener coupled to said second opposing wall.

5. The receptacle of claim 1, further including said extrusions being substantially rectangular.

6. The receptacle of claim 1, further including said slot being substantially centrally positioned in said panel.

7. The receptacle of claim 1, further including said slot being elongated, said slot having rounded ends.

8. The receptacle of claim 1, further including a plurality of holes, said holes being positioned through said panel between said slot and an edge of said panel.

9. The receptacle of claim 8, further comprising:

said holes being substantially circular; and said holes being substantially evenly spaced.

10. The receptacle of claim 8, further including said plurality of holes comprising between four and twenty holes.

11. The receptacle of claim 10, further including said plurality of holes comprising between eight and twelve holes.

12. The receptacle of claim 11, further including said plurality of holes comprising ten holes.

13. The receptacle of claim 1, further including each said penetration being positioned through a respective said lower extrusion.

14. The receptacle of claim 1, further including each said penetration being positioned through a respective said upper extrusion.

15. The receptacle of claim 1 further including said penetrations being substantially rectangular.

16. The receptacle of claim 1, further including a plurality of slats, said slats being coupled to and extending perpendicularly from a lower face of said panel, said slats being positioned in parallel on said lower face, such that said slats extend from said lower face to said bottom when said panel is positioned in said gap, wherein said slats are positioned on said panel such that said panel is configured to support items placed onto an upper face of said panel.

17. Combination trash liner storage and trash receptacle comprising:

a housing, said housing comprising a wall extending upwardly from a bottom defining an open top;

a plurality of fasteners, each said fastener being coupled to an interior surface of said housing proximate to a bottom of said housing, each of said plurality of fasteners being positioned equally distant from said bottom defining an internal perimeter of said housing;

a panel, said panel being substantially complementary to said internal perimeter, said panel being reversibly couplable to said fasteners, wherein said fasteners are positioned on said interior surface such that said panel is couplable to said fasteners to position said panel in substantial parallelism with said bottom;

a slot, said slot being positioned in said panel;

a plurality of penetrations, said penetrations being positioned in said wall, wherein said penetrations are configured to allow air to pass through said wall of said housing;

wherein said slot is configured for insertion of an end of a roll of trash can liners such that the roll of trash can liners is positioned adjacent to said lower face of said panel, wherein said panel is insertable through said open top such that said panel is coupled to said fasteners, wherein said open top is configured to couple with the open end of the trash can liner, and wherein said penetrations are positioned in said wall such that air can escape through said wall as items are added to the trash can liner;

a plurality of slats, said slats being coupled to and extending perpendicularly from a lower face of said panel, said slats being positioned in parallel on said lower face, such that said slats extend from said lower face to said bottom when said panel is positioned in said gap, wherein said slats are positioned on said panel such that said panel is configured to support items placed onto an upper face of said panel, said plurality of slats comprising two slats defining a central compartment, said central compartment comprising said slot, said central compartment being substantially rectangularly box shaped, said slats defining a pair of outer compartments.

18. The receptacle of claim 17, further including each of said outer compartments and said central compartment being substantially equally sized.

19. Combination trash liner storage and trash receptacle comprising:

a housing, said housing comprising a wall extending upwardly from a bottom defining an open top, said bottom being substantially rectangular, wherein said housing is substantially rectangularly box shaped, said bottom having rounded corners;

a plurality of fasteners, each said fastener being coupled to an interior surface of said housing proximate to a bottom of said housing, each of said plurality of fasteners being positioned equally distant from said bottom defining an internal perimeter of said housing, said plurality of fasteners comprising four fasteners, two of said fasteners being coupled to a first opposing wall of said housing, another two of said fasteners being coupled to a second opposing wall of said housing, such that a respective said fastener coupled to said first opposing wall is aligned with a respective said fastener coupled to said second opposing wall;

each said fastener comprising a pair of extrusions, each of said pair of extrusions being vertically aligned defining an upper extrusion and a lower extrusion, said upper extrusion and said lower extrusion being separated by a gap, said gap being complementary to a thickness of said panel, said lower extrusion extending from said wall further than said upper extrusion, said upper extrusion being deformable, wherein said panel is insertable through said open top of said housing, such that said panel is positionable in said gap with said lower extrusions and said upper extrusions retaining said panel in said gap, said extrusions being substantially rectangular;

a panel, said panel being substantially complementary to said internal perimeter, said panel being reversibly couplable to said fasteners, wherein said fasteners are positioned on said interior surface such that said panel is couplable to said fasteners to position said panel in substantial parallelism with said bottom;

a slot, said slot being positioned in said panel, said slot being substantially centrally positioned in said panel, said slot being elongated, said slot having rounded ends;

a plurality of holes, said holes being positioned through said panel between said slot and an edge of said panel, said holes being substantially circular, said holes being substantially evenly spaced, said plurality of holes comprising between eight and twelve holes;

a plurality of penetrations, said penetrations being positioned in said wall, wherein said penetrations are configured to allow air to pass through said wall of said housing, each said penetration being positioned through a respective said lower extrusion, each said penetration being positioned through a respective said upper extrusion, said penetrations being substantially rectangular;

a plurality of slats, said slats being coupled to and extending perpendicularly from a lower face of said panel, said slats being positioned in parallel on said lower face, such that said slats extend from said lower face to said bottom when said panel is positioned in said gap, wherein said slats are positioned on said panel such that said panel is configured to support items placed onto an upper face of said panel, said plurality of slats comprising two slats defining a central compartment, said central compartment comprising said slot, said central compartment being substantially rectangularly box shaped, said slats defining a pair of outer compartments, each of said outer compartments and said central compartment being substantially equally sized; and wherein said slot is configured for insertion of an end of a roll of trash can liners such that the roll of trash can liners is positioned adjacent to said lower face of said panel, wherein said panel is insertable through said open top such that said panel is coupled to said fasteners, wherein said open top is configured to couple with the open end of the trash can liner, and wherein said penetrations are positioned in said wall such that air can escape through said wall as items are added to the trash can liner.

* * * * *